US005259824A

United States Patent [19]

Cheltenham

[11] Patent Number: 5,259,824

[45] Date of Patent: Nov. 9, 1993

[54] HAND-HELD, FRICTION STABILIZED, MULTI-EXERCISE DEVICE

[76] Inventor: Eugene Cheltenham, 1823 Hollyvista Ave., Los Angeles, Calif. 90027

[21] Appl. No.: 797,302

[22] Filed: Nov. 25, 1991

[51] Int. Cl.[5] ..... A63B 21/012

[52] U.S. Cl. ..... 482/114; 482/148; 482/141

[58] Field of Search ..... 482/91, 114, 148, 141; 15/220 R, 222, 229.2

[56] References Cited

U.S. PATENT DOCUMENTS

| | | | |
|---|---|---|---|
| D. 96,483 | 8/1935 | Kurtz | 15/220 R |
| D. 203,279 | 12/1965 | Spackman et al. . | |
| D. 262,815 | 1/1982 | Lambert, Jr. et al. . | |
| 1,113,791 | 10/1914 | Latella . | |
| 1,401,476 | 12/1921 | Jordan et al. . | |
| 1,630,467 | 5/1927 | Bradstreet . | |
| 1,824,920 | 9/1931 | Novak . | |
| 2,286,324 | 6/1942 | Wentz . | |
| 2,528,213 | 10/1950 | Dantolan . | |
| 2,821,394 | 1/1958 | Barbeau . | |
| 2,855,201 | 10/1958 | Yetton . | |
| 2,920,418 | 1/1960 | Britt . | |
| 2,973,962 | 3/1961 | Griffin . | |
| 3,115,338 | 12/1963 | Acs et al. . | |
| 3,178,180 | 4/1965 | Morgan . | |
| 3,298,688 | 1/1967 | Grzybowski . | |
| 3,403,906 | 10/1968 | Burzenski | 482/141 |
| 3,572,701 | 3/1971 | Agamian . | |
| 3,664,666 | 5/1972 | Lloyd . | |
| 3,805,314 | 4/1974 | Del Bel | 15/222 |
| 3,912,263 | 10/1975 | Yatso . | |
| 3,912,264 | 10/1975 | Busse et al. . | |
| 4,046,373 | 9/1977 | Kim . | |
| 4,272,070 | 6/1981 | Schachner et al. . | |
| 4,336,623 | 6/1982 | Lin | 15/222 |
| 4,351,525 | 9/1982 | Rozenblad | 482/141 |
| 4,358,106 | 11/1982 | Shadford . | |
| 4,385,760 | 5/1983 | Mattox et al. . | |

*Primary Examiner*—Stephen R. Crow
*Attorney, Agent, or Firm*—William W. Haefliger

[57] ABSTRACT

A hand-held, friction stabilized, multi-exercise device comprising a body having a substantially flat, wall frictionally gripping surface thereon, the surface facing laterally; and manually grippable handles carried by the body and projecting in longitudinally opposite directions at opposite sides of the body. Two such bodies, connected by a bar or bar assembly, may be employed during exercise.

2 Claims, 4 Drawing Sheets 13a
10
11d
15b
14b
14
28b
15
13
12
28
11
70a
13b 2
12a
30
13a
70b
Y
22

12
11
10
11b
13
15
20
70a
70
70c
13b
m
F
F2
F1
2

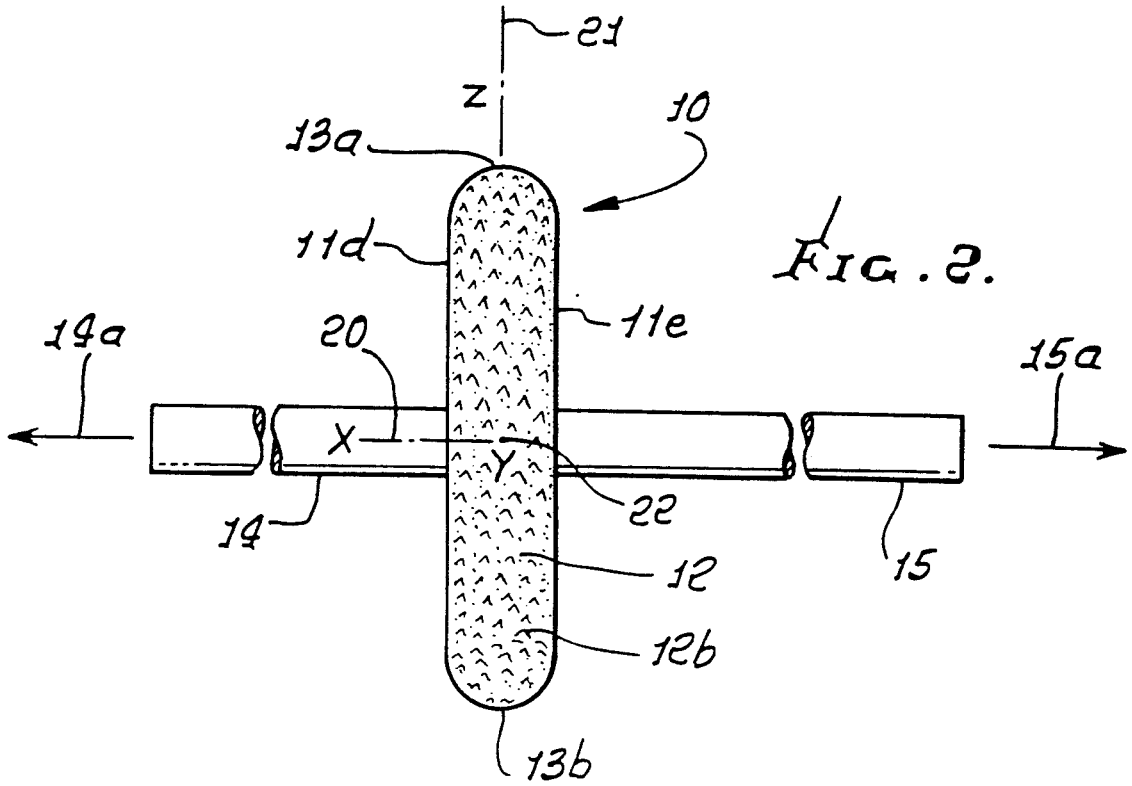
FIG. 2.
FIG. 3.
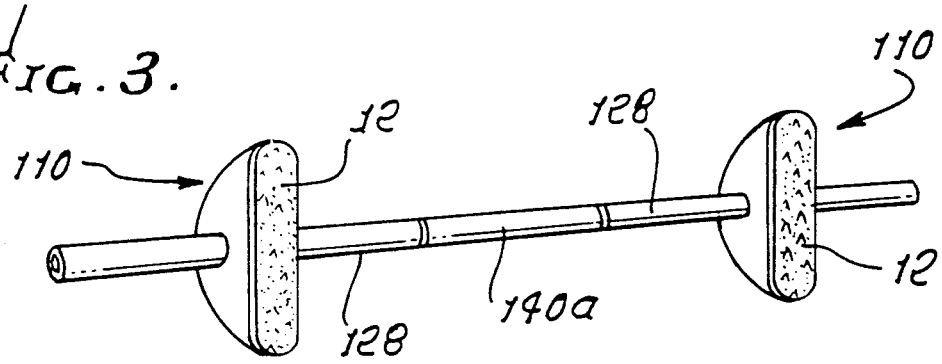
FIG. 3a.
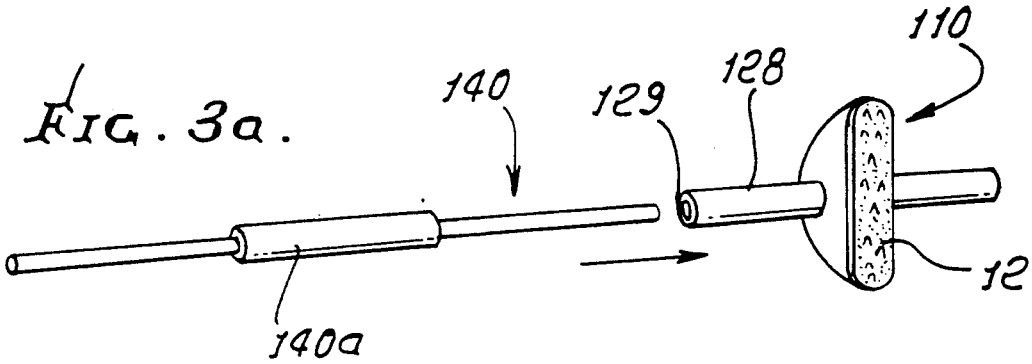

HAND-HELD, FRICTION STABILIZED, MULTI-EXERCISE DEVICE

BACKGROUND OF THE INVENTION

This invention relates generally to exercising equipment, and more particularly to a unique hand-held, friction stabilized, multi-exercise device.

There is a continual need for safe, easy to use, inexpensive, portable, exercise equipment, that will enable the user to perform a wide variety of safe exercise routines.

SUMMARY OF THE INVENTION

It is a major object of the invention to meet the above need, through provision of a hand-held, friction stabilized, multi-exercise device, which basically comprises:

a) a body having a substantially flat, wall frictionally gripping surface thereon, the surface facing laterally, b) and manually grippable handles carried by the body and projecting in longitudinally opposite directions at opposite sides of the body.

As will appear, the handles or hand grips define a longitudinal axis, and the wall-gripping surface is offset laterally from that axis.

In an X-Y-Z rectangular coordinate system, the handles extend along the X axis; the body projecting along the Y axis and the friction surface being laterally offset from the X axis and extending substantially parallel to the Z axis.

It is another object to provide, in such a device, a wall-gripping surface that comprises elastomeric material, and which may define a tread, such for example open cell Neoprene foam rubber, or other material such as of the type provided on tennis shoes, i.e. a roughened or grooved, or pocketed rubber surface. Typically, the body and tread are vertically elongated, and the longitudinal axis extends substantially horizontally in laterally offset relation to the tread. Two such bodies and wall grip surfaces thereon may be provided, and connected by an elongated bar and shaft, slidably disassembled and assembled, and which enhances wall grip and enables user's arm separation during exercise. Of advantage is the fact that no moving parts are required.

The basic method of the invention includes:

i) manually gripping the handles;

ii) exerting force on the handles to push the tread against the wall;

iii) and pushing against the handles in a direction having a vertical component.

Advantages of the invention include:

1. The user can do a wide variety of exercises using many different muscle groups, either exercising them singly or in combination. The primary muscle groups to benefit from exercise and muscle growth are: upper abdominals, lower abdominals, obliques, lower back, upper back, shoulders, trapezius, pectorals, deltoids, triceps, biceps, forearms, calves, and buttocks.
2. The user does the exercises while standing, instead of lying or sitting on the floor.
3. The device is constructed for use by a wide age range—from children to the elderly.
4. It is constructed for use by a wide ability range—from the physically challenged to the well-conditioned athlete.

5. It eliminates back strain associated with certain exercises, such as push-ups, sit-ups, and abdominal exercises.
6. It is completely portable.
7. The device has the advantages of multiple exercise devices, such as lat pull-down machines, chin-up bars, sit-up and abdominal apparatuses, barbells, and dumbbells.
8. The device can be used singly or in a combination of two units connected by a rigid connector bar.

These and other objects and advantages of the invention, as well as the details of an illustrative embodiment, will be more fully understood from the following specification and drawings, in which:

DRAWING DESCRIPTION

FIG. 1 is a perspective view showing one form of the invention;

FIG. 1*a* is a side elevational view of the FIG. 1 device applied to a vertical wall;

FIG. 2 is an enlarged view taken on lines 2—2 of FIG. 1*a*;

FIG. 3 is a view like FIG. 1 showing a modified form of the FIG. 1 device;

Figure 1:
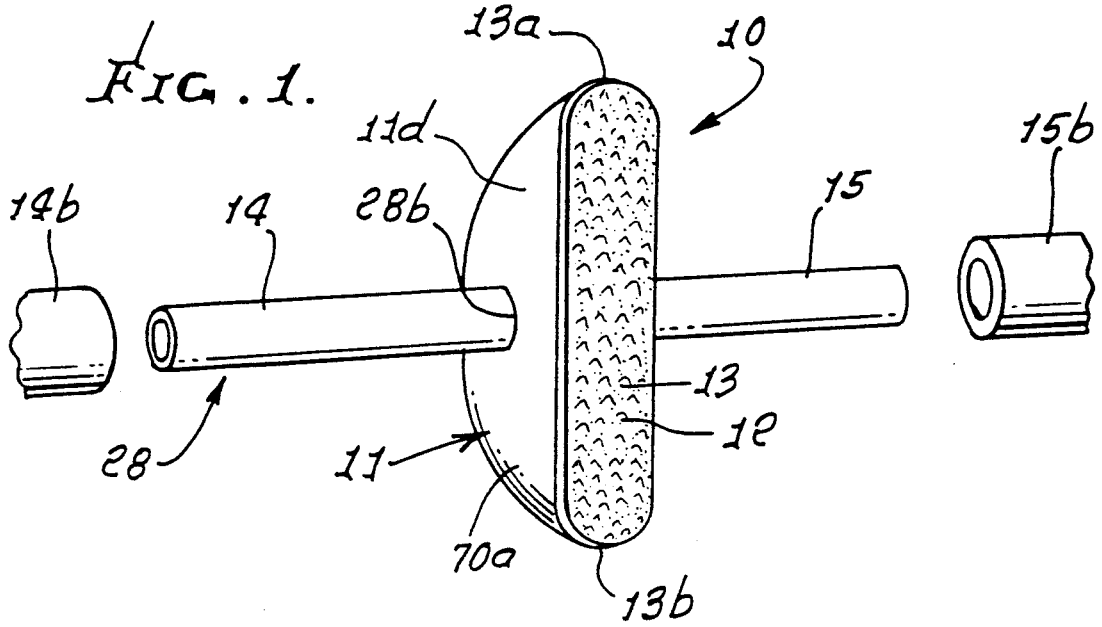
Figure 7:
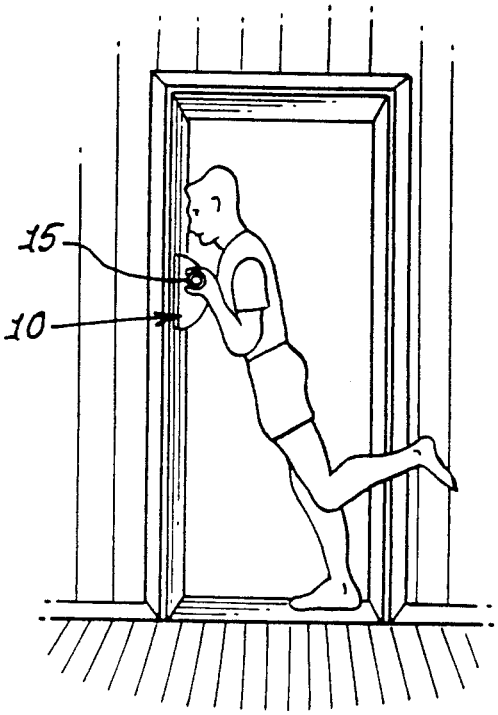
Figure 8:
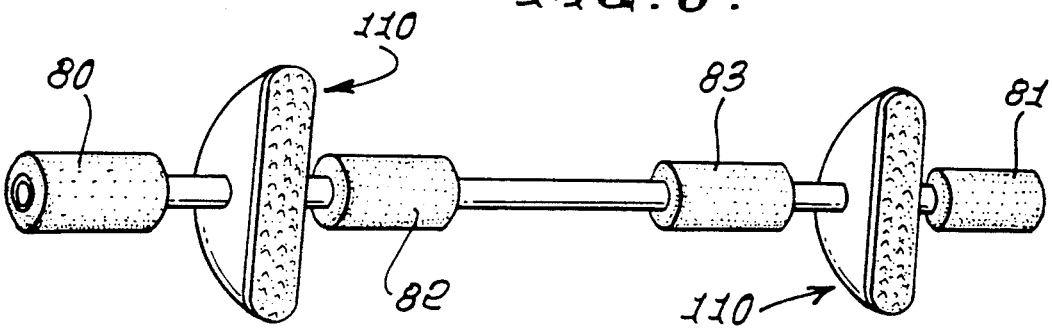

FIG. 3*a* shows the device of FIG. 3 disassembled;

FIGS. 4–7 are elevations illustrating multi-exercise uses of the device of FIG. 1, by an exerciser; and FIG. 8 shows another modified form of the apparatus.

DETAILED DESCRIPTION

Figure 1A:
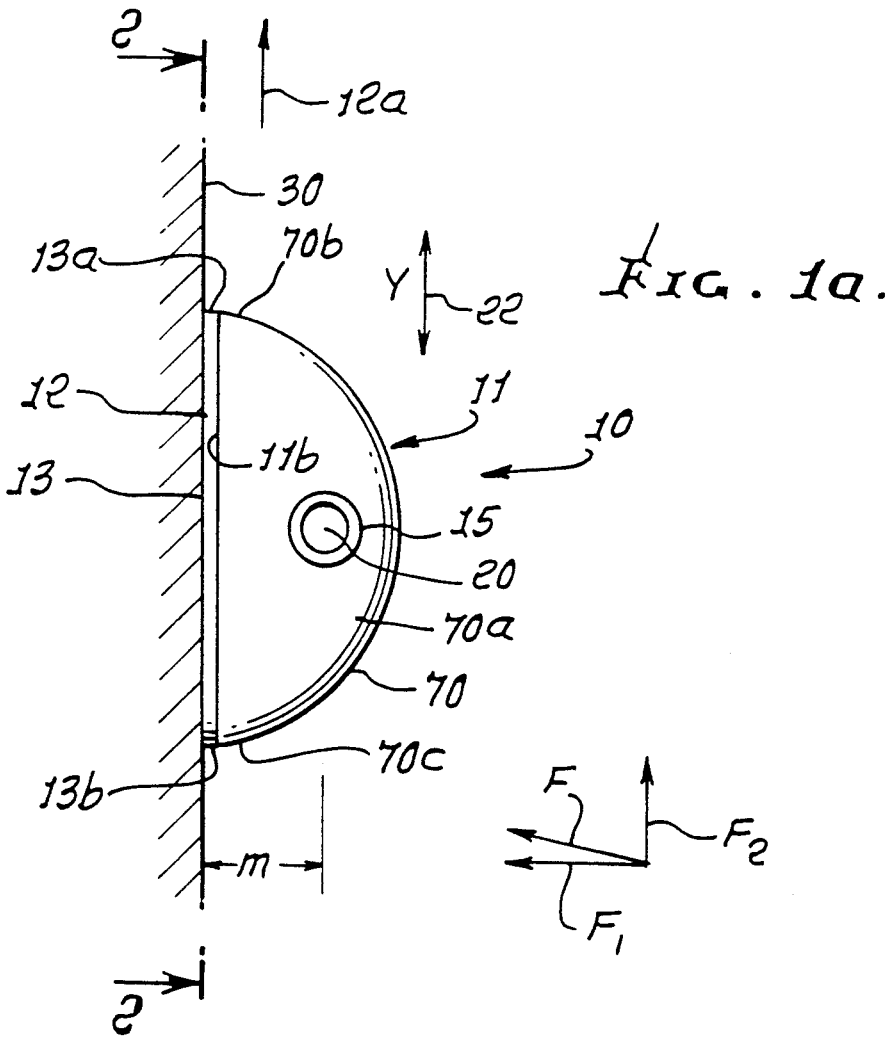

In FIGS. 1, 1*a* and 2, a hand-held, frictionally stabilized, multi-exercise device 10 is shown to include a body 11 having a substantially flat, wall frictionally-gripping surface 12 thereon, that surface facing in lateral direction 13 in FIG. 1*a*. Manually grippable handles 14 and 15 are carried by the body and project in longitudinally opposite directions at opposite sides of the flat-walled body. See directions 14*a* and 15*a* in FIG. 2. The handles define a longitudinal axis (see X-axis 20 in FIG. 1*a*); the wall-gripping surface 12 is offset laterally (see offset "m" in FIG. 1*a*) from axis 20, in "Y" axis direction 22; and the wall-gripping surface 12 extends vertically, or in a direction 12*a*, parallel to Z-axis 21, in FIG. 1*a*. Also, see these axes 20, 21, and 22 in FIG. 2.

Such axes form a rectangular XYZ coordinate system. The plane of surface 12 is substantially flat; and it is advantageously defined by an elastomeric tread 12*b*, or roughened surface, which is rectangular and vertically elongated in FIG. 2. Such tread is formed as a strip, bonded or joined to body flat surface 11*b*. Other shapes of surface 12 may be employed.

The handles are typically defined by a longitudinally elongated shaft 28, projecting at opposite sides of the body 11. The shaft may be firmly attached or made integral with the body 11 (as by passage through a body bore 28*b* and bonding to that bore) to transmit force exerted by the user, via shaft, body, and tread 12, to the wall 30. Elastomeric hand grips may be fitted over the handles 14 and 15, if desired. These are indicated at 14*a* and 15*a*. Frictional gripping of the tread against the surface 30 occurs by force exertion in a component direction $F_1$ seen in FIG. 1*a*. Push direction force is shown at F, and upward force component at $F_2$.

Body 11 is shown as having a semi-circular rim 70 meeting the tread ends at opposite ends 70*c* and 70*b* of the rim. Tread ends 13*a* and 13*b* are semi-circular, and flush with the body rim curvature at 70*a* that merges with flat parallel sides 11*d* and 11*e* of the body.

The method of using the device, as described, includes the steps:

i) manually gripping the handles:

ii) exerting force on the handles to push the tread against the wall, iii) and pushing against the handles in a direction having a vertical component, as at $F_2$ in FIG. 1*a*.

Figure 4:
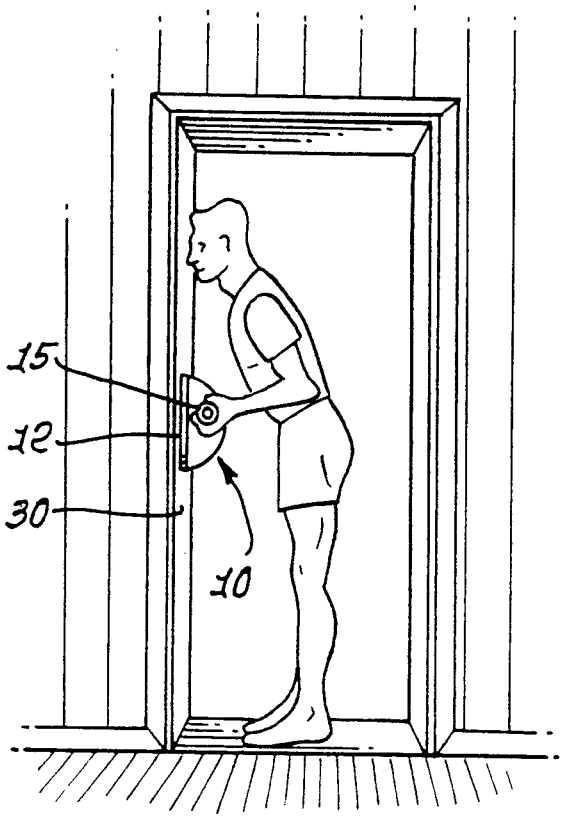

The vertical component $F_2$ may be upward or downward. See FIGS. 4–7 showing different user exercise stances, using the described device. In FIG. 4, the user pushes against the device and pulls upward. A complete "standing sit-up" routine, as in FIG. 4, includes the steps:

Place device against wall at waist level.

Toes 18 inches from wall (fingertip-to-elbow length).

Feet a few inches apart.

Palms up grip.

Bend forward slightly at waist.

Tighten stomach muscles and pull upper body slowly forward towards device.

With elbows bent, tighten arm muscles for medium resistance against the pull of stomach muscles.

Relax and repeat 10–20 repetitions for beginners; 20–60 reps for intermediates; 60–100 reps for advanced users.

A "biceps builder" exercise would include:

Placing device against wall waist high.

Standing with toes 18 inches from the wall (the length of fingertips to elbow).

Spread feet a few inches apart.

Grip device with both hands using a palms-up grip.

Lean slightly forward at the waist and keep body straight.

Slowly pull up, using upper arm muscles; and hold for a few seconds. Exhale during hold.

Slowly release and inhale deeply. Repeat several times.

Move exerciser device up, 2–4 inches. Repeat the pull-up, hold and release steps until device is at chest height.

Figure 5:
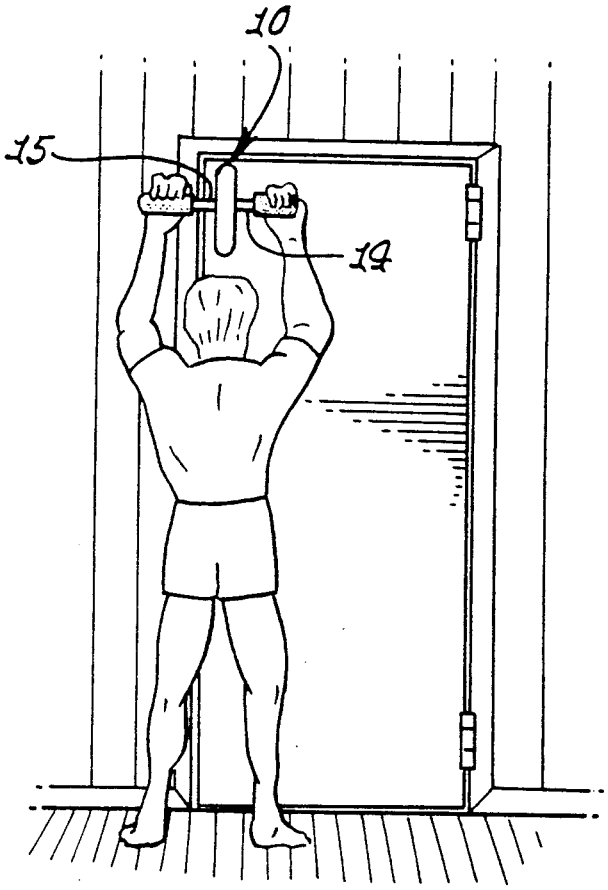
Figure 6:
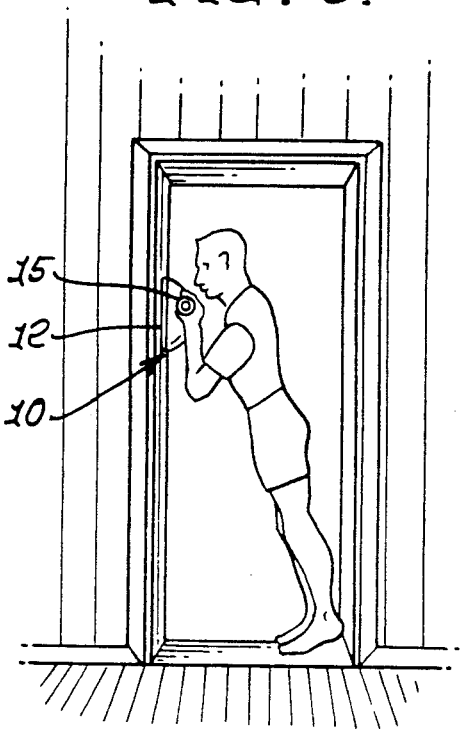

A latissimus dorsi muscle builder exercise is shown in FIG. 5 and includes the steps:

Stand a full arms length from a wall or securely closed door. Spread feet a few inches apart.

Place the exerciser firmly against the surface at least one foot above head.

Grasp the hand grips with palms towards face.

Keep body straight. Lean slightly towards the wall or door.

Pull down slowly using latissimus muscles not arm muscles. Hold for 5–10 seconds, and exhale.

Slowly release. Inhale deeply. Repeat for 5–10 repetitions.

Move exerciser down 2–4 inches. Repeat pull down and release steps until the exerciser is chest high.

An abdominal stretch routine (see FIG. 6) includes the steps:

Stand a full arms length from a wall, a securely closed door or a door frame. Feet a few inches apart.

Place exerciser firmly against the surface at shoulder height.

Grasp the hand grips with an overhand grip (palms down).

Bend arms until forearms are parallel to the surface.

Keep body straight.

Raise up slightly on toes.

Lean entire body slowly forward until face is inches from the surface.

Exhale and tighten stomach muscles as tight as possible. Hold for 3–5 seconds.

Slowly straighten arms until standing vertical. Repeat for 5–10 repetitions.

Move the exerciser up 4–8 inches. Repeat last three steps until the exerciser is up as high as you can reach.

FIG. 7 shows use of the device in a calf builder routine, including the steps:

Stand a full arms length from a wall, a securely closed door or a door frame. Feet close together.

Place exerciser firmly against the surface at chest height.

Grasp the hand grips in an underhand grip (palms up).

Keep body straight. Lean forward until head almost touches the surface.

Keep elbows firmly at sides.

Start with heels on the floor. Raise left foot, bending leg at the knee.

Slowly raise up on right foot. Stand on toes for 3–5 seconds.

Slowly lower right heel to the floor Repeat for 5–10 repetitions.

Switch feet and do another 5–10 repetitions.

By keeping arms locked, resistance is created against which the calves can exercise.

Referring now to FIGS. 3 and 3*a*, modified apparatus shown in FIG. 3*a* includes two units or sections 110, each like device 10 described above. Another elongated connection shaft 140 passes endwise longitudinally through bores 129 in the unit shafts 128 and through an auxiliary intermediate tube 140*a* between the sections 110. The shafts 128 and shaft 140 may have frictional interfit or retainers may be employed to interconnect 128 and 140.

FIG. 3*a* shows the elements of FIG. 3 in disassembled state.

FIG. 8 shows the apparatus of FIGS. 3 and 3*a*, with elastomeric tubular hand grips 80 and 81, and 82 and 83.

The actual use of the device also includes the following:

1. User stands facing a wall or closed door.
2. The exercise device is placed with the friction pads against the wall or closed door.
3. The user grasps the hand grips and leans slightly forward towards the exercise device causing the exercise device to produce a non-slip or gripping action as a result of frictional engagement with the wall.
4. When the gripping action takes place, the user can perform a wide variety of lifts, pulldowns and body lowering exercises. Friction will keep the exercise device in one place.
5. By repositioning the exercise device higher or lower, different parts of the muscle groups can be exercised. Repositioning and repeating the exercise produces effects similar to those obtained by using a range of motion device or certain weightlifting devices.
6. Incremental repositioning of the apparatus during the exercise will have the effect of exercising the muscle through a full range of motion. This produces well-rounded muscle development.

7. Minimal repositioning of the device during exercise will have the effect of isometric exercise and will produce finer muscle definition.

I claim:

1. In a hand-held, friction stabilized, multi-exercise device, the combination comprising:

a) a body having a substantially flat, elongated wall frictionally gripping surface thereon, said surface facing laterally, b) and manually grippable handles carried by said body and integral therewith, and projecting in longitudinally opposite directions at opposite sides of said body, c) said handles defining a longitudinal axis, and said wall-gripping surface being offset laterally from said axis, said handles elongated in said longitudinally opposite directions, and wherein in an XYZ axis rectangular coordinate system, said handles extend generally horizontally along the X axis; said body projects along the Y axis and said surface being laterally offset from said X axis; and said surface substantially parallel to said Z axis, said surface extending in a plane substantially parallel to said X and Z axes, d) said handles being substantially equally spaced at opposite sides of said body, and being substantially cylindrical, there being spacing between said handles and said plane defined by said wall frictionally gripping surface, said spacing exceeding the diameter of said handles, e) and said wall gripping surface comprises elastomeric material defining a tread, and said body and said tread being elongated in said Z direction, and said longitudinal axis extending in said X direction in laterally offset relation to said tread, f) whereby said spacing of the handles from said wall engaging tread surface is sufficient to resist slippage of the tread on and along a tread engaging wall surface when the handles are manually grasped and force is exerted on the handles toward the wall surface and in said Z direction.

2. The combination of claim 1 wherein said Z axis extends vertically, and said X axis extends horizontally, whereby said tread surface is applicable to a vertically extending wall with said handles extending longitudinally and horizontally.

* * * * *